US005222737A

United States Patent [19]

Kazuk

[11] Patent Number: 5,222,737

[45] Date of Patent: Jun. 29, 1993

[54] SLOPING TABLE SLIDING PUCK GAME

[76] Inventor: Walter F. Kazuk, 5152 Boggy Creek Rd., E-35, St. Cloud, Fla. 34771

[21] Appl. No.: 833,374

[22] Filed: Feb. 10, 1992

Related U.S. Application Data

[63] Continuation-in-part of Ser. No. 648,151, Jan. 30, 1991, Pat. No. 5,161,801, which is a continuation-in-part of Ser. No. 474,368, Feb. 2, 1990, abandoned.

[51] Int. Cl.[5] ..... A63B 71/04

[52] U.S. Cl. ..... 273/126 A; 273/127 A; 273/126 R

[58] Field of Search ..... 273/108, 118 R, 118 A, 273/118 B, 119 R, 119 A, 120 R, 120 A, 121 R, 121 A, 122 R, 122 A, 124 R, 124 A, 125 R, 125 A, 126 R, 126 A, 127 R, 127 A

[56] References Cited

U.S. PATENT DOCUMENTS

| | | | |
|---|---|---|---|
| 3,762,711 | 10/1973 | Cooper | 273/126 R |
| 3,887,187 | 6/1975 | Crossman et al. | 273/126 A |
| 3,907,294 | 9/1975 | Breslow | 273/126 R |
| 4,173,341 | 11/1979 | Olliges | 273/126 A |
| 4,215,863 | 8/1980 | Kuiper | 273/126 R |
| 4,790,535 | 12/1988 | Droske | 273/122 R |

*Primary Examiner*—William H. Grieb
*Assistant Examiner*—Raleigh W. Chiu

[57] ABSTRACT

A sloping table sliding puck game and method for playing the same. A table having a substantially frictionless is elevated at an angle. A rebounding device is placed at one end of the table. A game player at the other end of the table projects a puck along the top surface of the table toward targets adjacent the rebounding device with a hand paddle. The table is sloped to force the puck to return to the game player. Optical sensors detect when the puck passes over the targets. A chute is located behind the rebounding device. When the game is over the rebounding device drops permitting the puck to enter the chute. The chute is constructed to return the puck to the player at the other end of the table from the rebounding device before the start of the next game.

7 Claims, 3 Drawing Sheets

SLOPING TABLE SLIDING PUCK GAME

This application is a continuation-in-part of application Ser. No. 07/648,151 filed Jan. 30, 1991 now U.S. Pat. No. 5,161,801 which is a continuation-in-part of application Ser. No. 07/474,368 filed Feb. 2, 1990, and now abandoned.

BACKGROUND OF THE INVENTION

This invention relates to an amusement device and, more particularly to, a sliding puck game and method for playing the game.

Heretofore, table games using a bat and a sliding puck have been utilized needing two players to compete. U.S. Pat. No. 3,773,325 and U.S. Pat. No. 3,887,187 cover the Air Hockey Table and require two players to operate the game. Scoring is accomplished by the puck being driven into the opposing side's goal. The puck is then retrieved by the players and set upon the table to be played again. Scoring is accomplished by electrical means and indicated on the sideboards. Here the game requires two players to operate the table while the locking out mechanism at the end of the game can be overcome by obstructing the goal at each end. The game can be played continuously without interruption except for scoring on the scoreboard.

U.S. Pat. No. 3,228,688 also discloses a game requiring two players. Although the game is scored electrically, it is conceivable to play the game using two players without initiating the scoring system. The game is intended to be used as a operated game.

U.S. Pat. No. 4,032,150 is a two player game that does not lend itself to coin operation. The scoring end of the table, the puck and the paddles are constantly available to be played by anyone that happens to be in the vicinity. Once again, the game cannot be played by an individual player and requires two players to compete against one another.

U.S. Pat. No. 3,871,585 discloses a frictionless game table that uses a round ball that rolls back and forth on a table. However, this table may present problems when a puck is used as the game's playing object. The puck when slowly propelled toward the side of the table may become stuck and may stop sliding. This stoppage would interrupt the game.

Another surface sliding puck game is disclosed in U.S. Pat. Nos. 2,634,130 and 2,505,238. The games have a projectile device that travels from one end of a table to the other. However, when a puck is used on these tables it may become entrapped under the backboard at one end of the table if not projected with adequate velocity. Further, these games have the drawback that when the game ends, the player may have to walk up to the far end of the table to recover the projectile device before beginning the next game.

SUMMARY OF THE INVENTION

Accordingly, several objects and advantages of the invention are proposed including a puck and bat game table which utilizes high speed, single player action incorporating a high speed rebound mechanism.

An object of the game is to require skill and speed to achieve a high score on a vertical display board within a given length of playing time. This puck and paddle device requires only one player to operate the game.

Additional objects of my invention are to provide the basic sloped game table for high speed scoring and play, with the added possibilities of replacing the basic game with additional games varying the timing requirements and the scoring techniques.

A further object is to use optics with a reflective game table surface to sense the movement of the puck to provide more accurate and reliable puck detection.

These and other objects are accomplished by placing a puck on a sloping table with a backboard at the table's highest elevated end. The game player stands at the lower end of the table. The player then continuously hits the puck against targets located adjacent the backboard. If the player misses the puck, the puck lands in a penalty area adjacent the lower end of the table.

In one game, ten targets and associated target lights are active. Optic beams are directed at targets on preset locations on a reflective material adjacent a rebounding device on the top surface of the table. The reflection of the optic beam is sensed by an optical detector. When the puck passes across the beam the optical detector senses the absence of the reflection and provides an electronic signal indicator. The electronic signal is fed to the display to provide an indication to the game player that the target has been hit. As the puck strikes each target it records a hit and extinguishes the light to make it inactive and a score of "1" is recorded on the scoreboard. After hitting the tenth target the scoreboard shows a score of ten. The targets then recycle such that all the targets and lights become active again. During operation the pucks hit the targets extinguishing the lights and scoring on the scoreboard. The game operation continues until such time that the timer stops the play action electrically and lowers the rebound gate to capture the puck. The accuracy of the player and the speed with which he delivers the puck before the rebound gate opens to capture the puck results in his highest score. Once the rebound gate captures the puck, the puck is fed down a chute where it is stored until the game is to be played again. To play the game again the game player inserts a coin into the slot, allowing the puck to be discharged at the same side of the table where the game player is located. Thus, the game player does not have to retrieve the puck from the backboard end of the table.

Additional games using the same basic game table configuration with a different scoreboard and electronic circuits could be as follows.

In a further game, the number of targets are increased to thirty with ten indicator lights in which three of the targets are tied together electronically and represent a single light. On the first hit of the target, that is, one of the three targets, that particular light would be extinguished, making that particular target inactive. The thirty targets occupy most of the width of the target area so that on the first strike, it not only extinguishes that light, but starts the count on the clock. This gives the novice a chance to eliminate all ten lights on the first go-around. On recycling the targets for the second go-around, one of the targets is eliminated from the three that are assigned to each target light. This leaves a space between target areas that could be missed by the inexperienced player, thereby reducing the potential score. On the third recycle of the targets, since only one target is available to be hit, greater accuracy on the part of the player is required to achieve a high score. Subsequent recycling would be with the single target available for each target light until the conclusion of the playing time.

In another embodiment of the invention, upon acceptance of the coin by a coin slot on the game table, the rebound gate is raised, and a single target and its associated light are illuminated. The player hits the puck. Upon a first strike by the player of a rebound gate, a hit of the target, or movement of the puck over a preset location on the top surface of the table, a timing clock is initiated. The scoreboard records a hit by the puck on the target with "2" points and a miss of the target is counted as a "−1" and recorded on the scoreboard in another display indicating the number of strikes that are achieved. That is, of the ten passes at the targets, if five of the passes were hits for a count of two each, and if five were strikes or misses, the total score on the scoreboard would be "5." That is, two points for each of the five hits minus one point for each of the five misses equals a total of five.

In another suggested game, once again a single target is illuminated and upon being hit, the target will be randomly shifted to one of the other positions. Again, the total running time of the game is predetermined. A hit on the target is recorded on the scoreboard as "5", a strike or a miss of the target is recorded as "1" in a second window on the scoreboard. A third window shows the total score which is multiplication of the number of hits times the number of strikes. For example, one hit at five points times ten strikes at one point each would give you a total score of 50.

It becomes obvious that the number of variations in the basic game table are innumerable as long as it involves the total running time, the hits that are made on the targets and the strikes of the backboard. The game might conceivably be played using two bats, two pucks, pucks of smaller diameters, paddles with smaller puck contact faces, and two or more active targets. The game playing levels from novice to expert are determined by the padded face size and the puck diameter in play. The puck diameter is dependent on the maximum and minimum puck size that will pass through the capture and return system. With an appropriate scoreboard and associated detection circuitry, competitive team play can be promoted.

DESCRIPTION OF THE PREFERRED EMBODIMENTS

Figure 1:
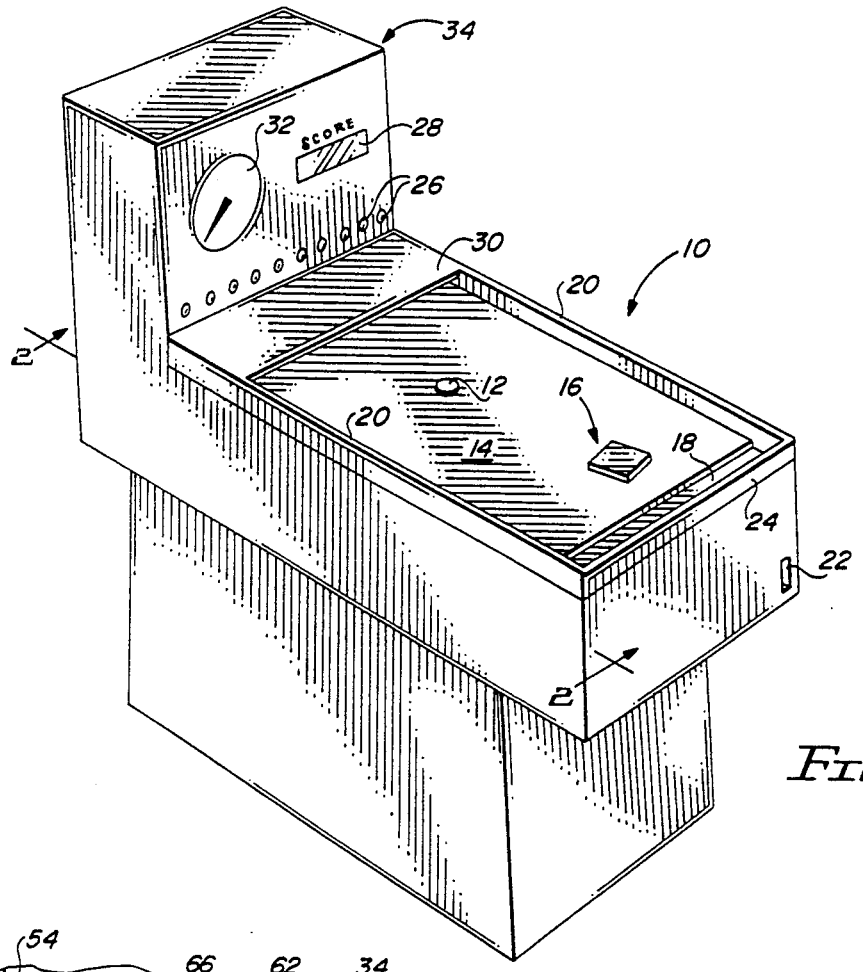
FIG. 1 is a perspective view of the game table incorporating the invention.

Referring to FIG. 1, a typical embodiment of the proposed game table 10 is shown. Sloping game table 10 with associated scoreboard 34 is mounted on a suitable base to elevate it to a typical height of 30 inches at the player end of the table.

The game table 10 typically is rectangular in shape. All external surfaces are typically of a ¾ inch sheet of plywood material. The game table surface 14 is a low friction surface with respect to the playing puck 12. The slope of the table is interdependent on the sliding friction of the puck 12 on the game table 10. In this case, the slope of the table is in the order of 2.5 inches of incline to every foot in length. The criteria for the slope of table surface 14 is assurance of the return of puck 12 to the player end of game table 10 under static conditions and provide sufficient magnitude to assure the return of puck 12 in puck return chute 38. Also resting on table surface 14 is paddle 16 which is used for striking puck 12.

A puck dispenser 22 at the front base of the table dispenses playing puck 12 upon activation of the game by depositing a coin. A bat or paddle 16 and puck 12 are of a molded ABS plastic that is black in color. Sloping surface 14 is white HDPE plastic for a contrast between table surface 14 and puck 12, and provides a substantially frictionless surface.

The detection technique of recording and displaying hits and strikes is optional. That is, electrical, mechanical, magnetic, optical or any sensing technique can be employed. The method of displaying strikes and hits and playing time or combinations thereof is also optional.

Electrical, mechanical, electronic, etc. programming of the game is optional. That is, the number of possible variations of games the game table is capable of is unlimited.

Referring to FIG. 1, the face of scoreboard 34 houses clock 32 with its time preset to a given playing cycle. One revolution is typically thirty seconds which results in the termination of the game. Scoreboard display window 28 is a numeric display. The quantity of score display windows 28 will be increased depending upon the variations of the game. Low voltage target indicators 26 are positioned along the bottom face of scoreboard 34 and are active target hit strike zone areas.

Figure 2:
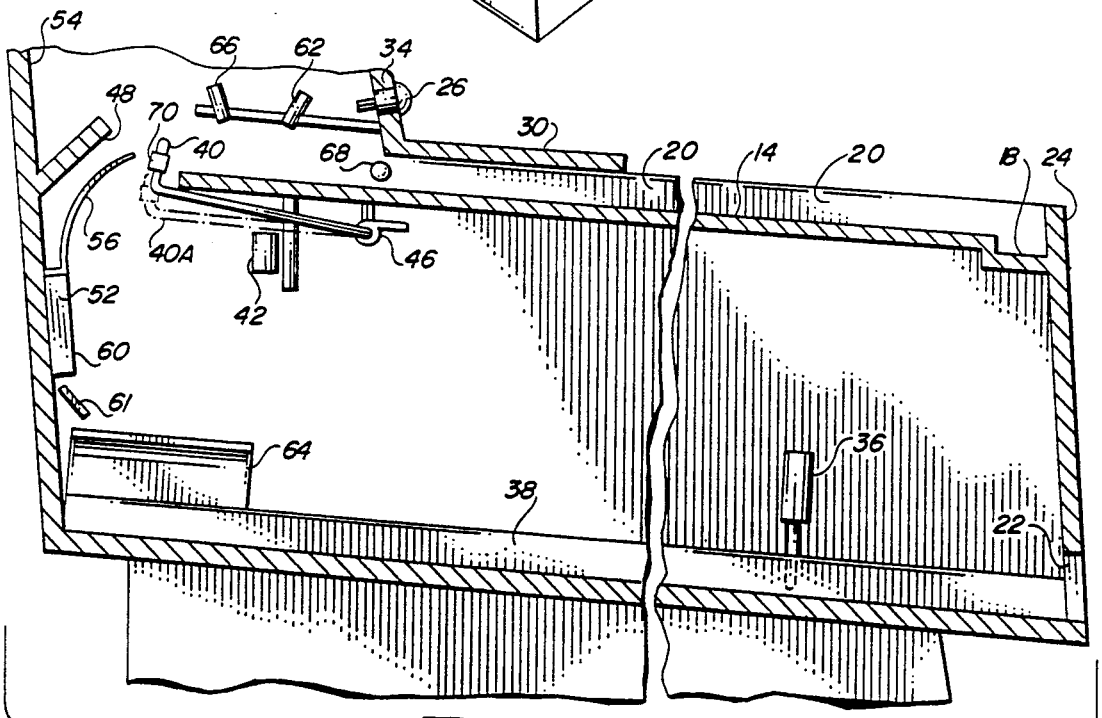
FIG. 2 is a cross-sectional view of the game table cut along line 2—2 of FIG. 1.

Referring to FIG. 2, game table 10 is bounded on either side by low guard rail 20 just above playing surface 14 of table 10. Penalty box 18 is bounded by player guard rail 24 to keep puck 12 from coming off table 10 at the player end. Penalty box 18 is a gutter adjacent and having a level below playing surface 14 at the player's end of table 10. The elevated scoreboard 34 houses target indicators 26 and an optional operational circuit. An opaque target area cover 30 is typically 15 inches in length and covers the full width of table 10. Rebound gate 40, shown in a closed position, is activated by solenoid 42 to the open 40A position at the termination of play to capture puck 12. With rebound gate 40 in the open 40A position, puck 12 is directed to puck deflector 48. Puck guide 50 directs puck 2 to backboard incline 52. Puck 12 rolls on its edge to guardrail void 72 in the backboard incline guardrail 60. Gravity forces puck 12 to drop onto vertical to horizontal puck ramp 61. Puck 12 is rotated to align with and roll down puck return chute 38. Puck 12 is then held at puck release solenoid 36 until released at the initiation of the next game.

Figure 3:
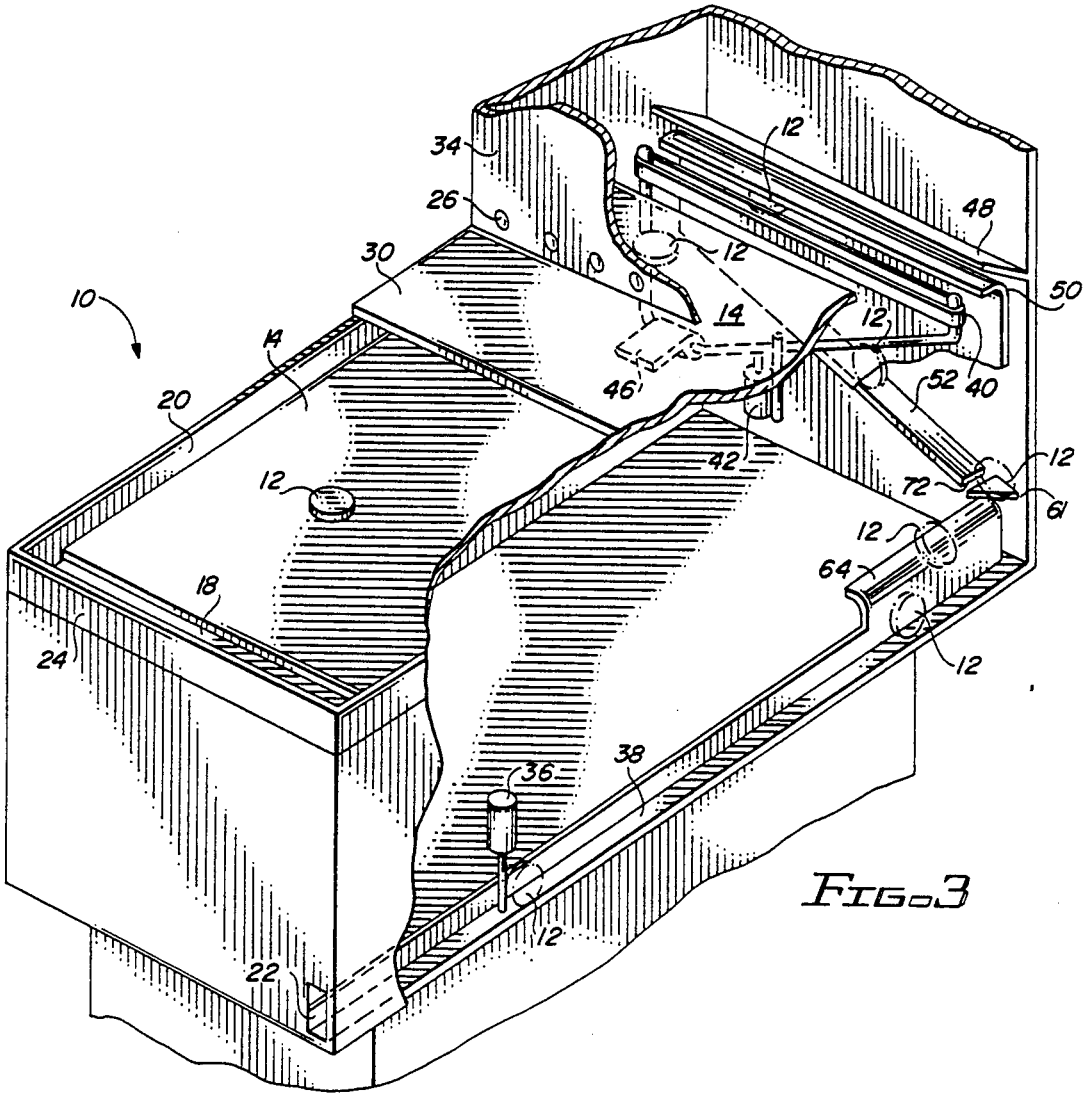
FIG. 3 is a cross-sectional back view of the game table shown in FIG. 1 with a captured puck moving in the backboard and sideboard.
Figure 7:
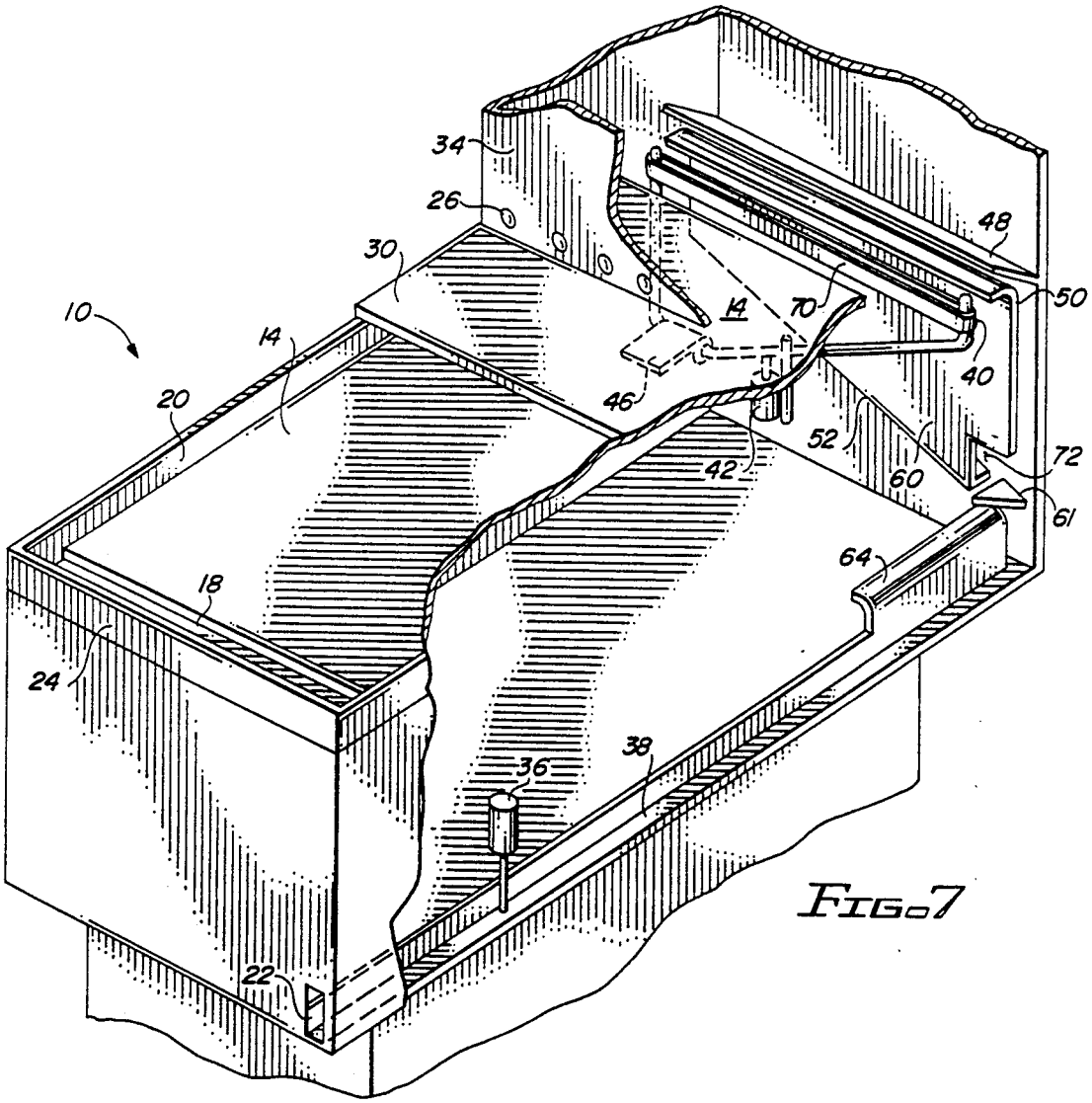
FIG. 7 is a cutaway view of the game table shown in FIG. 1.

Referring to FIG. 2, FIG. 3 and FIG. 7, puck 12 progresses in the following sequence when captured. At the end of the timed play rebound gate 40 opens to **40*a* position directing puck 12 to puck deflector 48 and puck guide 50. Puck 12, now in a vertical position, rolls on it's edge down backboard incline 52 to drop through guard rail void 72. Vertical to horizontal puck ramp 61** deflects puck 12 to a horizontal position. Puck 12 is then directed by the curved horizontal to vertical puck ramp 64 to puck return chute 38.

The critical components to assure pivoting of puck 12 and alignment with puck return chute 38 are the vertical to horizontal puck ramp 61 and horizontal to vertical puck ramp 64.

Figure 4:
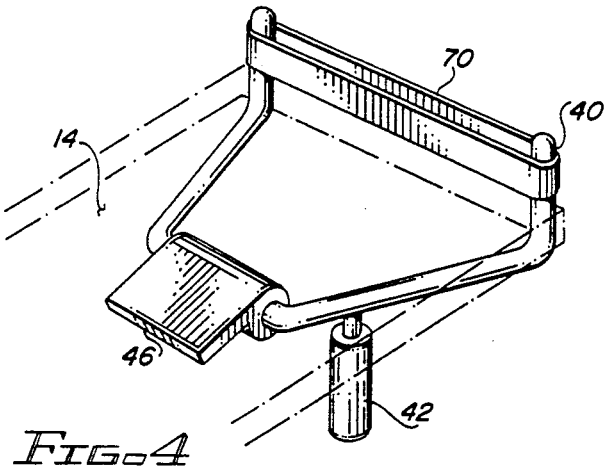
FIG. 4 is a perspective view of the rebound gate shown in FIG. 2.

Referring to FIG. 4 and FIG. 7, the rebound gate 40 assembly is formed using a ¼ inch, diameter steel rod 40 that exceeds the dimension of the puck rebound band 70, thereby effecting a spring to rebound a puck on impact. The puck rebound band 70 is preferably constructed with a ½ inch polypropylene strapping. Gate pivot hinge 46 supports rebound gate 40 and allows an open rebound gate 40*a* position at the termination of a game by deenergizing gate solenoid 42 resulting in band 70 lowering. This puck may slide overboard an into backboard incline 52.

Figure 5:
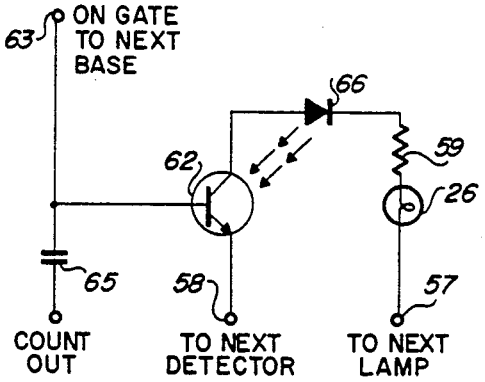
FIG. 5 is a schematic diagram of the electronic target hit and indicator circuits for the game table shown in FIG. 1.

Referring to FIG. 5, there is shown an optional circuit of one of any number of target hit indicator detectors. In this case there are ten detectors depicted. All electrical contacts are common or in parallel to one another.

A trigger electrical pulse applied to on gate 63 and base of photodarlington transistor 62 resulting in photodarlington transistor 62 being enabled. In response to photodarlington transistor 62 being enabled, current flows through resister 59 to target indicator 26 and light emitting diode 66. Referring to FIGS. 2 and 5, photodarlington transistor 62 detects when puck 12 interrupts the focused energy beam of light emitting diode 66 reflecting off of reflective material 99 on game table surface 14.

This reflective material may be embedded on surface 14 of the table or may be a tape that removably adheres to table surface 14. Preferably, reflective material 99 extends laterally across table 14 from one side to the other. Photodarlington transistor 62 breaks a circuit so as to indicate a hit when a puck crosses over reflective material 99 and intercepts the beam. Target indicator 26 responds to the broken circuit by going out. A score is then recorded on scoreboard 34 through coupling capacitor 65. Count out terminal 56, positive terminal 57, negative terminal 58, and on gate terminal 63 are common to all target hit indicator detectors. Target indicators 26 are re-excited by a pulse at on gate terminal 63 by the circuit program or the next game.

Figure 6:
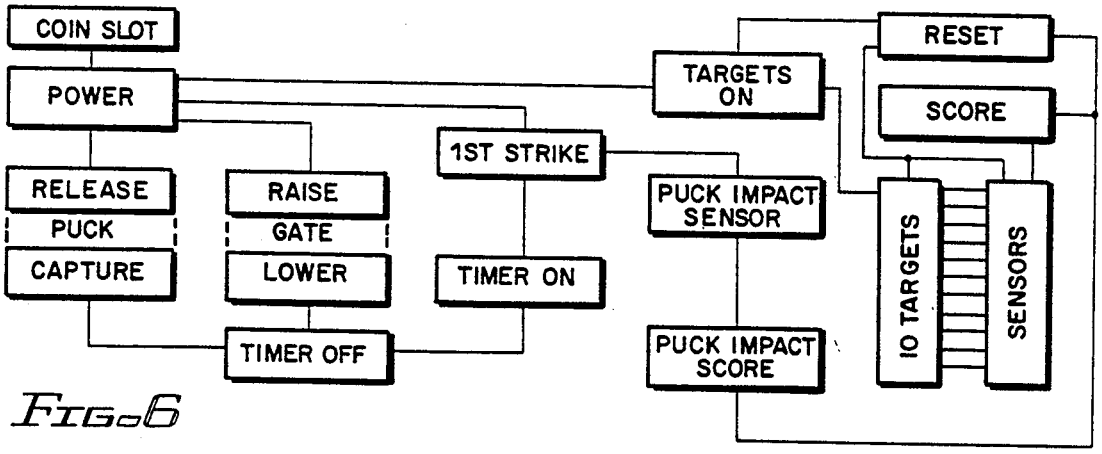
FIG. 6 is a block diagram of the electronics for the game table shown in FIG. 1.

Referring to FIG. 6, a typical block diagram of the circuit for the game is shown. With power applied to the game, reset activation of the game is commenced by placing a coin in a slot which in turn resets target indicators 26, raises rebound gate 40 and releases puck 12 for the play. The player places puck 12 on game table surface 14 and pushes puck 12 toward target indicators 26 with paddle 16. First strike of puck 12 interrupts the beam of optoelectronic puck detector 68 and activates clock 32 to start the allotted running time on the scoreboard. Interruption of the light beams between light emitting diode 66 and transistor 62, and of optoelectronic puck detector 68 by puck 12 extinguishes respective target indicator 26 and a hit is recorded. Puck 12 comes in contact with puck rebound band 70 and is deflected back to the player.

In one version of the game, a reset is initiated after all ten target indicators 26 and associated gate sensors in transistor 62 and diode 66 have been hit. A score is recorded on score window 28 and target indicators 26 are re-excited for continuation of play until such time as timing clock 32 is turned off. Rebound gate 40 is lowered and puck 12 is captured and held in return chute 38 by puck release 36 until another coin has been placed in the slot to re-initiate the game. One such puck release mechanism is a solenoid. When another coin is placed in the slot to re-initiate the game, a signal is sent by a coin capture mechanism (not shown) to enable puck release 36. Puck release 36 then retracts allowing puck 12 to slide down return chute 38 into puck dispenser 22. Although coin capture mechanism is not shown, this device is preferably a known coin capture mechanism and is mounted on the side of game table 10.

Referring to FIG. 1, inclined table surface 14, puck 12 and paddle 16 are of a low friction material. Table 10 perferably has an inclination as previously described to prevent the puck from sticking to the table during game operation. A player, after activating the game by depositing a coin, receives puck 12 from puck dispenser 22. Timing clock 32 and the score are set at zero. Target indicators 26 are all illuminated. The contestant places puck 12 on game table surface 14 and with paddle 16 hits puck 12 towards target indicators 26. The object of the game is for puck 12 to strike one of the target indicators 26 and extinguish it.

The first impact of puck 12 initiates the beginning of the allotted playing time. Scoreboard 34 continues the action of clock 32 and score display window 28 as each target indicator 26 is extinguished.

Guard rail 20 prevents puck 12 from being ejected from playing surface 14. Cover 30 increases the apparent speed as puck 12 is returned to the player. Should the player miss puck 12 with paddle 16, puck 12 will be captured by penalty box 18 and player end guard rail 24, thereby causing the player to lose playing time on scoreboard 34 while clock 32 continues to run.

This concludes the description of the preferred embodiments. A reading by those skilled in the art will bring to mind various changes without departing from the spirit and scope of the invention. It is intended, however, that the invention only be limited by the following appended claims.

What is claimed is:

1. A method of playing a game with a puck on a sloped surface of a table extending between a first end and a second end, the method comprising the steps of:

contacting the puck with a hand held paddle disposed on the surface of the table to propel the puck with an initial velocity along a path on the surface of the table from the second end toward a plurality of reflective target areas adjacent the first end;

contacting one of the plurality of target areas with the puck as the puck travels along the path;

elevating the entire surface of the table between the first and second end at an angle with respect to horizontal, said angle being selected so that when the puck travels from the second end toward the first end, the puck always returns to the second end regardless of the puck's initial velocity;

recontacting the puck with the hand-held paddle to propel the puck back toward the first end to contact another of the plurality of target areas as the puck returns to the second end of the table from the first end of the table; and providing an indication when the puck contacts the target areas by optically sensing when the puck passes over a target area through detection of the reflectivity of the target areas.

2. The method of playing a game as recited in claim 1 further comprising the step of rebounding the puck traveling along the path with a rebound gate disposed adjacent the first end.

3. A method of playing a game with a puck on a sloped surface of a table extending between a first and a second end, the method comprising the steps of:

contacting the puck with a hand held paddle disposed on the surface of the table to propel the puck along a path on the surface of the table from the second end toward the first end with an initial velocity;

elevating the entire surface of the table between the first and second end at an angle with respect to horizontal, said angle being selected so that when the puck travels from the second end toward the first end, the puck always returns to the second end regardless of the puck's initial velocity;

recontacting the puck with the hand-held paddle to propel the puck back toward the first end to contact one or more of target areas as the puck returns to the second end of the table from the first end of the table; and providing a penalty box disposed adjacent the second end with a top surface having an elevation lower than the surface of the table for trapping the puck if the hand held paddle misses the puck during playing of the game.

4. A sliding puck game comprising:

a table having a top surface with a surface extending between a first end and a second end;

a reflective material on the top surface of the table adjacent the rebounding means;

a puck operative to be projected along a path on the surface of the table between the first end and the second end;

rebounding means disposed adjacent the first end of the table for rebounding the puck when projected along the path;

means for directing an optical beam at a preset location on the reflective material adjacent the rebounding means so that said optical beam reflects off of the reflective material;

means disposed above the top surface of the table for optically sensing when said puck passes over said preset location by sensing the presence or absence of the reflection; and means responsive to said optical sensing means for providing an electronic signal indicating said puck has passed over said preset location.

5. The sliding puck game as recited in claim 4 wherein said optically sensing means includes a photo transistor.

6. The sliding puck game as recited in claim 4 wherein said directing means includes a photodiode.

7. The sliding puck game as recited in claim 4 wherein said directing means is disposed above the top surface of the table.

* * * * *